US006167680B1

(12) United States Patent
Horn

(10) Patent No.: US 6,167,680 B1
(45) Date of Patent: Jan. 2, 2001

(54) PORTABLE DISPLAY CASE

(75) Inventor: Sidney Horn, 304 Woods Way, Dublin, GA (US) 31021

(73) Assignee: Sidney Horn, Dublin, GA (US)

( * ) Notice: Under 35 U.S.C. 154(b), the term of this patent shall be extended for 0 days.

(21) Appl. No.: 09/429,766

(22) Filed: Oct. 28, 1999

(51) Int. Cl.[7] ..... B65D 25/54

(52) U.S. Cl. ..... 53/473; 206/776; 220/4.23; 220/324; 220/377; 220/507; 220/520; 220/602

(58) Field of Search ..... 206/736, 776; 220/315, 324, 377, 520, 524, 507, 602; 446/73; 53/473

(56) References Cited

U.S. PATENT DOCUMENTS

| | | | | |
|---|---|---|---|---|
| D. 174,914 | | 6/1955 | McGee . | |
| D. 174,915 | | 6/1955 | McGee . | |
| 1,610,146 | | 12/1926 | Panzer . | |
| 1,699,765 | * | 1/1929 | Staples | 220/520 |
| 2,107,194 | | 2/1938 | Yacker et al. . | |
| 2,245,999 | | 6/1941 | Plotkin . | |
| 2,558,124 | * | 6/1951 | Burden | 220/520 |
| 2,645,332 | * | 7/1953 | Martin et al. | 206/315 |
| 3,310,905 | | 3/1967 | Davis et al. . | |
| 3,391,765 | | 7/1968 | Baker . | |
| 4,209,085 | | 6/1980 | Kozan . | |
| 4,486,018 | * | 12/1984 | Keller, Jr. | 220/377 |
| 4,693,371 | * | 9/1987 | Malpass | 206/561 |
| 4,934,549 | * | 6/1990 | Allen | 220/524 |
| 5,042,193 | | 8/1991 | Steiner . | |
| 5,163,578 | | 11/1992 | Eitreim et al. . | |
| 5,402,885 | | 4/1995 | Cook et al. . | |
| 5,894,928 | * | 4/1999 | Chang | 220/665 |
| 5,927,501 | * | 7/1999 | Herbruck | 206/541 |

* cited by examiner

*Primary Examiner*—Jim Foster
(74) *Attorney, Agent, or Firm*—Kristin L. Johnson; Kilpatrick Stockton LLP

(57) ABSTRACT

A portable storage and display case for toy action figurines. Compartments, located within the case, allow the user to strategically place the figurines within the case. Transparent walls facilitate use of the case for display purposes in addition to allowing the user to quickly assess its contents and easily locate desired figurines within the case.

15 Claims, 2 Drawing Sheets

PORTABLE DISPLAY CASE

FIELD OF THE INVENTION

This invention relates to a portable display case primarily, but not necessarily exclusively, for toy action figurines.

BACKGROUND OF THE INVENTION

Portable cases for storing and transporting articles have been in existence for a long time. Moreover, many of these cases provide compartments to facilitate organization of the articles within the case. For example, U.S. Pat. No. 2,558,124 discloses a tackle box containing plates for creating compartments within the box. U.S. Pat. No. 2,107,194 discloses a container specially designed to organize and store stamps and labels. Suitcases and tool boxes are yet other examples of portable cases for organizing articles. These cases, however, are generally made from opaque materials, preventing the user from assessing the contents without physically opening the case. Consequently, the user is also precluded from using such cases for display purposes. Moreover, these cases generally provide for storage on only one side of the case.

SUMMARY OF THE INVENTION

The display case of the present invention provides a portable, transparent case for storage and display of toy action figurines. Compartments, located within the display case, allow the user to strategically place the figurines within the case. Moreover, the compartments also prevent shifting and/or intermingling of the figurines. Unlike prior storage cases, the present invention is transparent and therefore also serves as a display case. The transparency of the case also allows the user to quickly assess its contents and easily locate desired figurines within the case. A version of the case wherein each side is equipped with compartments ("the two-sided display case") allows storage on both sides of the case, thus doubling the number of figurines that may be stored and displayed in the case.

It is an object of the present invention to provide a portable case for storage of action figurines.

It is another object of the present invention to provide a case with transparent walls for displaying action figurines within the case.

It is still another object of the present invention to provide a case that prevents the contents of the case from intermingling.

It is yet another object of the present invention to provide a case which retains the contents in assigned compartments when the case is upright or being transported.

It is yet another object of the present invention to provide a two-sided case which allows for storage and display of action figurines on both sides of the case.

DETAILED DESCRIPTION OF THE DRAWINGS

Figure 1:
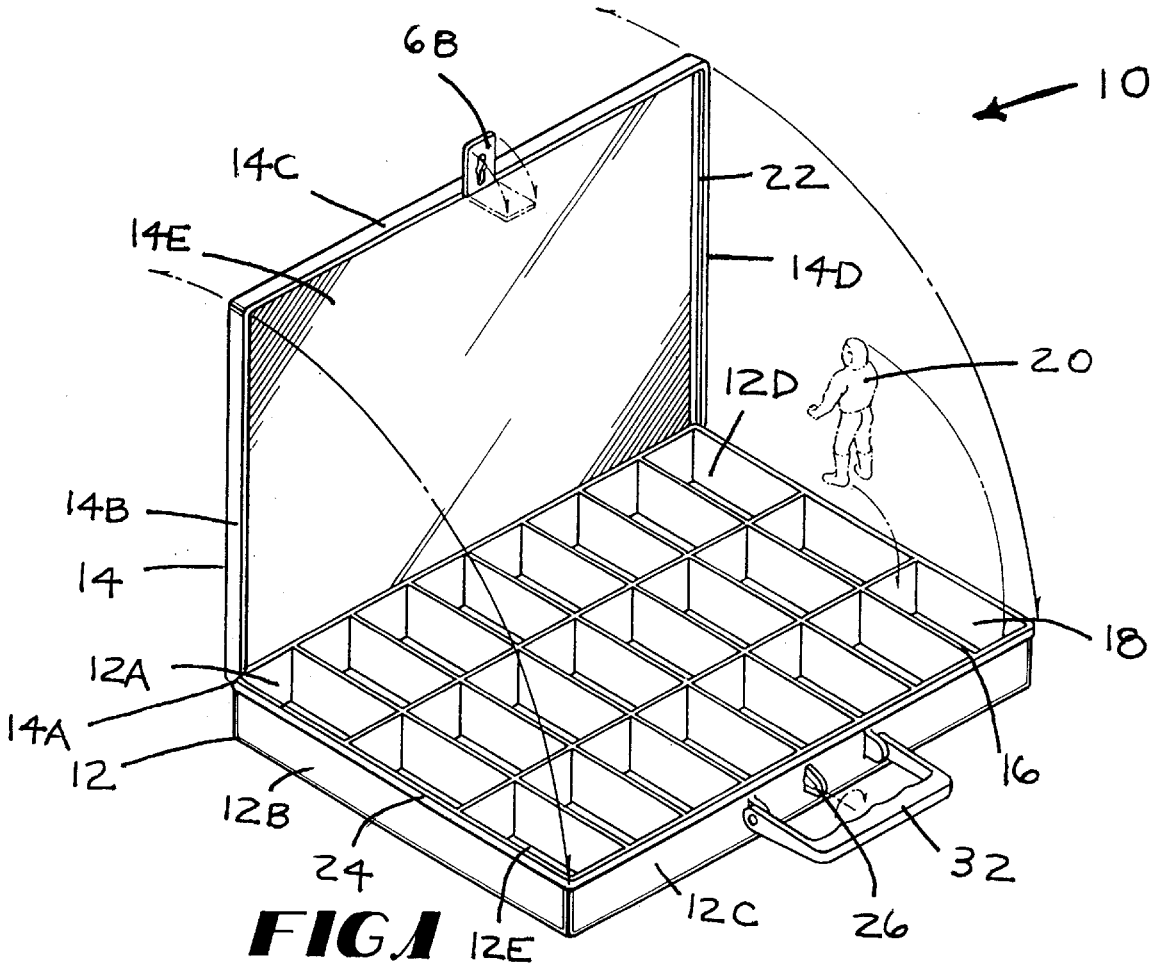
FIG. 1 is a perspective view of one embodiment of a one-sided display case shown when open.

FIG. 1 illustrates a one-sided display case 10 of the present invention. Display case 10 comprises a base section

12 and a cover 14. The base section 12 has four walls 12A–D and a back panel 12E. The cover 14 has four edges 14A–D and a top panel 14E. The base section 12 and the cover 14 may be made from any transparent material such as plastic, but the material should be durable and rigid enough to maintain the shape of the display case 10. The upper edge of wall 12A of base section 12 and the adjacent edge 14A of cover 14 are hinged together. While any number of hinges are suitable for attaching the cover 14 to the base section 12, a live hinge is particularly effective as it secures together most or all of the entire length of the upper edge of wall 12A and edge 14A. Dividers 16 are located in the base section 12 and divide the area within the base section 12 into compartments 18. Action figurines 20 may be placed in compartments 18 for storage and, because the cover 14 and some or all of base section 12 are transparent, also for display.

Figure 2:
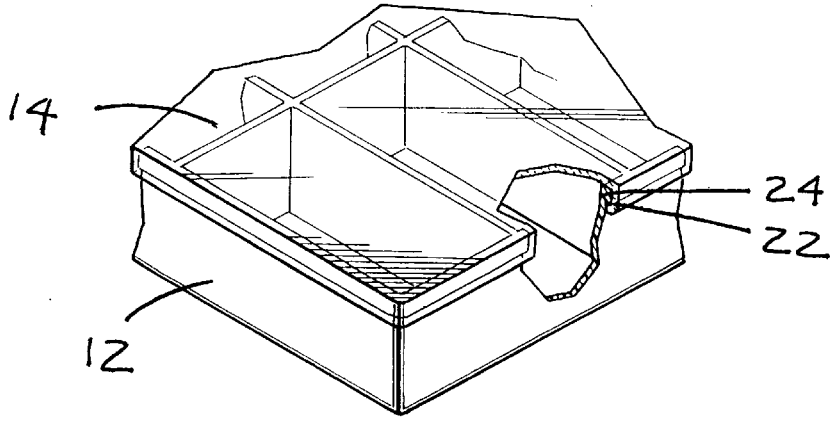
FIG. 2 is a perspective view of one corner of the one-sided display case of FIG. 1 shown when closed.

To seal the display case 10, the cover 14 is simply folded over the base section 12. The edges 14A–D of the cover 14 may contain a groove 22. The upper edges of the walls 12A–D of the base section 12 may contain a corresponding lip 24. When the cover 14 covers the base section 12, the groove 22 of the cover 14 interlocks with the lip 24 of the base section 12 as best seen in FIG. 2, thus ensuring a secure fit between the cover 14 and the base section 12. The cover 14 can further be secured to the base section 14 with a fastening device. While any number of fastening devices may be used, some embodiments of the invention use a device comprising a twist lock 26 and a hoop 68. A hoop 68 attached to at least one edge of the cover 14 (14C in FIG. 1) is threaded over a twist lock 26 attached to a base wall adjacent the edge when the case is closed (12C in FIG. 1). The twist lock 26 is then turned. A handle 32 may be located on the base section to facilitate transport of the display case.

Figure 3:
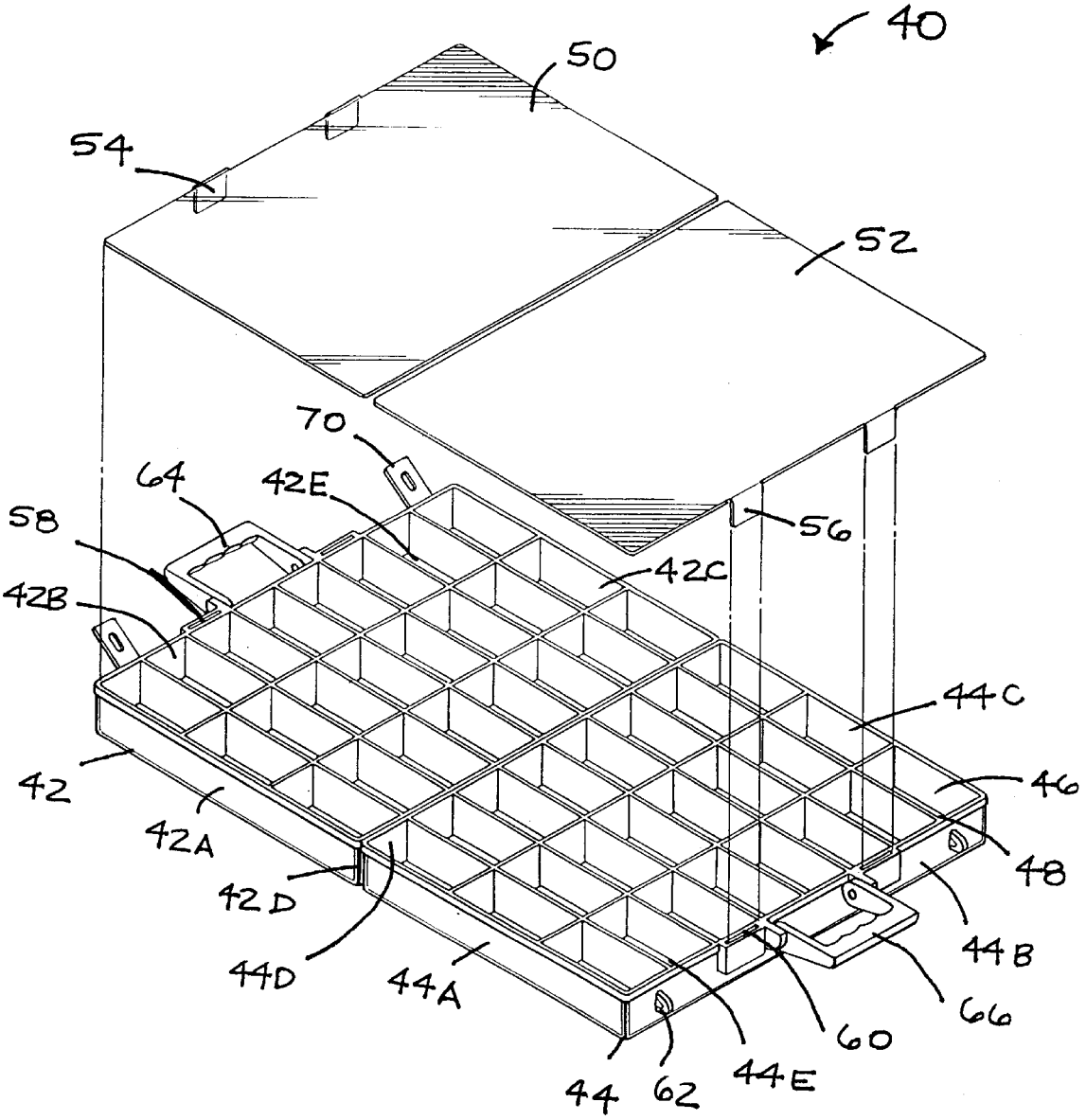
FIG. 3 is an exploded view of one embodiment of an open two-sided display case.

FIG. 3 illustrates a two-sided display case 40 of the present invention. In contrast to the one-sided display case 10 having a base section 12 and a cover 14, the two-sided display case 40 has two base sections 42, 44, both of which are divided into compartments 46 by dividers 48 as with base section 12 of the one-sided display case 10. The base sections 42, 44 may be hinged together just as the base section 12 and cover 14 are hinged in the one-sided embodiment. Each base section 42, 44 has four walls 42A–D, 44A–D and a back panel 42E, 44E. The two-sided display case 40 may be made from the same transparent material used to construct the one-sided display case 10.

Separator flaps 50, 52 are secured in the same hinge which attaches the base sections 42, 44 and fit between the two base sections 42, 44, thus ensuring the toy figurines remain in their respective base sections. The separator flaps 50, 52, as with the base sections 42, 44, arc preferably made from a transparent material. Wings 54, 56 integrally formed with and extending from the separator flaps 50, 52 fit in slots 58, 60 located on walls 42B, 44B of base sections 42, 44 to ensure that the separator flaps 50, 52 remain properly positioned when the display case 40 is upright or being carried. Once the separator flaps 50, 52 arc in place, the display case 40 is closed and the base sections 42, 44 are secured together with an appropriate fastener, such as a twist lock 62 and hoop 70. The same lip and groove configuration as described in connection with the one-sided display case 10 and illustrated in FIG. 1, may also be incorporated into the two-sided display case 40. A handle may be located solely on one base section, or alternatively, as shown in FIG. 3, half of a handle 64, 66 may be located on each base section 42, 44 so that when the display case 50 is closed, the halves of the handle 64, 66 come together to form a completed handle. This further helps ensure that the display case 40 remains closed during transport.

The foregoing is provided for purposes of illustrating, explaining, and describing embodiments of the present invention. Further modifications and adaptations to these embodiments will be apparent to those skilled in the art and may be made without departing from the scope or spirit of the invention.

What is claimed is:

1. A portable storage and display case comprising:

a) two base sections, each base section comprising four walls and a transparent back panel, wherein an upper edge of a wall of one base section is hinged to an adjacent upper edge of a wall of the other base section;

b) at least one divider that fits within each base section and divides each base section into multiple compartments; and c) two separator flaps hinged to the base sections, each flap fitting over a base section and separating the two base sections, wherein the separator flaps each comprise at least one wing extending from and integrally formed with the separator flap and at least one wall of each base section comprises a slot for receiving a wing.

2. The case of claim 1 wherein the separator flaps are transparent.

3. The case of claim 1 wherein the at least one divider is transparent.

4. The case of claim 1 wherein the base sections, separator flaps, and the at least one divider comprise plastic.

5. The case of claim 1 wherein an upper edge of a wall of one base section comprises a lip and an upper edge of a wall of the other base section comprises a groove for receiving the lip when the case is closed.

6. The case of claim 1 further comprising at least one fastener having two parts, one part of which is located on the wall of one base section and the corresponding part of which is located on an adjacent wall of the other base section.

7. The case of claim 6, wherein the two parts comprise a twist lock and a hoop.

8. A portable storage and display case comprising:

a) two plastic base sections, each base section comprising four walls and a transparent back panel, wherein an upper edge of a wall of one base section is hinged to an adjacent upper edge of a wall of the other base section, at least one wall of each base section comprising at least one slot and wherein an upper edge of a wall of one base section comprises a lip and an upper edge of a wall of the other base section comprises a groove for receiving the lip when the case is closed;

b) at least one plastic, transparent divider that fits within each base section and divides each base section into multiple compartments;

c) two plastic, transparent separator flaps hinged to the base sections, each flap fitting over a base section and separating the two base sections, wherein each flap comprises at least one wing extending from and integrally-formed with the separator flap for interlocking with the at least one slot of a base section; and d) at least one fastener having two parts, one part of which is located on the wall of one base section and the corresponding part of which is located on an adjacent wall of the other base section.

9. A method for displaying and storing toy figurines comprising:

a) providing a portable case, wherein the case comprises:

i) two base sections, each base section comprising four walls and a transparent back panel, wherein an upper edge of a wall of one base section is hinged to an adjacent upper edge of a wall of the other base section;

ii) at least one divider that fits within each base section and divides each base section into multiple compartments; and iii) two separator flaps hinged to the base sections, each flap fitting over a base section and separating the two base sections, wherein the separator flaps each comprise at least one wing extending from and integrally formed with the separator flap and at least one wall of each base section comprises a slot for receiving a wing; and b) placing at least one toy figurine in the case.

10. The method of claim 9, wherein the separator flaps are transparent.

11. The method of claim 9, wherein the at least one divider is transparent.

12. The method of claim 9, wherein the base sections, separator flaps, and the at least one divider comprise plastic.

13. The method of claim 9, wherein an upper edge of a wall of one base section comprises a lip and an upper edge of a wall of the other base section comprises a groove for receiving the lip when the case is closed.

14. The method of claim 9, wherein the case further comprises at least one fastener having two parts, one part of which is located on the wall of one base section and the corresponding part of which is located on an adjacent wall of the other base section.

15. The method of claim 9, wherein the case further comprises a handle located on the exterior of at least one wall of at least one base section.

* * * * *